US006035445A

United States Patent [19]

Lui

[11] Patent Number: 6,035,445

[45] Date of Patent: Mar. 14, 2000

[54] NON-FLOPPY SUN HAT

[76] Inventor: So Kum Lui, 2145 Brown St., Brooklyn, N.Y. 11229

[21] Appl. No.: 09/018,963

[22] Filed: Feb. 5, 1998

[51] Int. Cl.[7] ..... A42B 1/02

[52] U.S. Cl. ..... 2/175.1; 428/109; 428/112

[58] Field of Search ..... 428/109, 112; 2/175.1, 175.5, 175.8

[56] References Cited

U.S. PATENT DOCUMENTS

| | | | |
|---|---|---|---|
| 140,614 | 7/1873 | Cassiano | 2/175.1 |
| 3,898,699 | 8/1975 | Zientara et al. | 2/175.1 |
| 5,023,117 | 6/1991 | Stephens | 2/175.1 |
| 5,388,272 | 2/1995 | Epply | 2/175.1 |
| 5,488,740 | 2/1996 | Garza | 2/175.1 |

FOREIGN PATENT DOCUMENTS

| | | | |
|---|---|---|---|
| 22463 | 10/1907 | United Kingdom | 2/175.5 |

*Primary Examiner*—Alexander Thomas
*Attorney, Agent, or Firm*—Patent & Trademark Services; Joseph H. McGlynn

[57] ABSTRACT

A hat that is designed to be used to ward off the sun and has a crown and a brim. The brim has a series of stiffening rods attached thereto to hold the brim in a selected shape.

5 Claims, 1 Drawing Sheet

NON-FLOPPY SUN HAT

BACKGROUND OF THE INVENTION

This invention relates, in general, to hats, and, in particular, to sun hats that will not bend.

DESCRIPTION OF THE PRIOR ART

In the prior art various types of hats have been proposed. For example, U.S. Pat. No. 3,898,699 discloses a hat with a knitted crown and a stiff crocheted brim and a method of making the hat.

U.S. Pat. No. 5,023,117 discloses a hat with sliced apples attached to the hat for decoration.

U.S. Pat. No. 5,388,272 discloses a paper hat made from a stiffly flexible paper with a rectangular top and four rectangular side panels.

U.S. Pat. No. 5,488,740 discloses a reversible hat with two crown portions and two brim portions and an elastic band to allow the hat to fit different size heads.

None of the prior art hats take into consideration the use of a hat to shield the user from the sun. Today, it is common knowledge that the sun's rays can be harmful to a person's skin, and in some instances have caused skin cancer. In order to shield a person from the sun's rays, hats have been worn for some time. However, there has always been a problem in selecting a brim size that will adequately shield the user and at the same time will retain its shape over a period of time.

In order to be effective, a sun hat must be large enough to shield the user and at the same time, can be gently folded twice to a quarter of its sized to be stored in a tote bag, etc. when not in use, especially at the start of a late evening. It should also be small enough to retain its shape against the forces of gravity.

SUMMARY OF THE INVENTION

The present invention comprises a hat that is designed to be used to ward off the sun and has a crown and a brim. The brim has a series of stiffening rods attached thereto to hold the brim in a selected shape.

It is an object of the present invention to provide a new and improved hat that can be worn in order to shield the wearer from the sun.

It is an object of the present invention to provide a new and improved hat with an enlarged brim and stiffening elements to help the brim retain its shape.

These and other objects and advantages of the present invention will be fully apparent from the following description, when taken in connection with the annexed drawings.

DESCRIPTION OF THE PREFERRED EMBODIMENT

Figure 1:
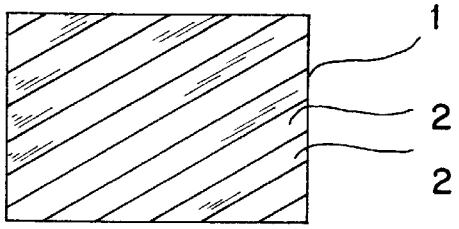
FIG. 1 is plan view of the material used to make the present invention.
Figure 3:
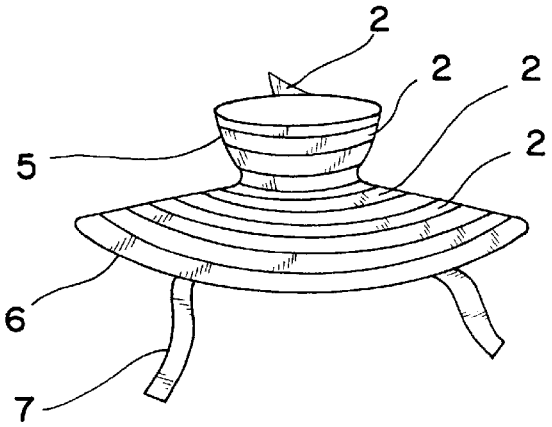
FIG. 3 is a view of the completed hat of the present invention.

Referring now to the drawings in greater detail, FIG. 1 shows a piece of material 1 that will be cut along a bias to form strips 2 which will be wrapped and attached to each other to form the hat shown in FIG. 3.

Figure 2:
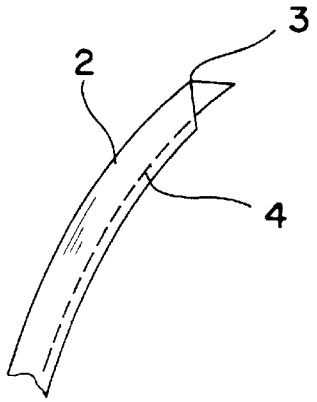
FIG. 2 is a view showing the material that has been cut to form the strips to make the hat of the present invention.

As shown in FIG. 2, after the strips 2 are cut from the material 1, the strips are folded along fold line 3, and then sewn along dotted line 4. Next the folded and sewn strips 2 are wrapped starting at the top of the crown 5 and continuing down to form the brim 6, as shown in FIG. 3. The strips 2 can be attached to each other in any conventional manner such as, but not limited to, hand sewing. In addition, the shape of the hat shown in FIG. 3 is merely for illustrational purposes and other shapes can be formed without departing from the scope of the present invention.

Figure 4:
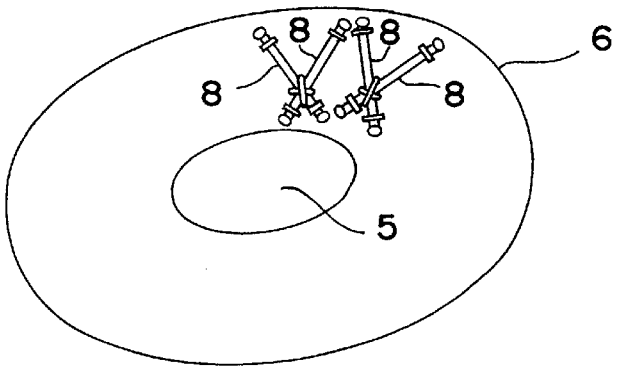
FIG. 4 is a view of the under side of the completed hat of the present invention.

Once the basic hat shape is formed, the stiffening ribs or rods 8 will be attached to the underside of the brim 6 as shown in FIG. 4. It should be noted that only two pair of the ribs or rods 8 are shown, however, the number of rods or ribs could be increased until they cover the entire underside of the brim. The number of rods or ribs 8 used will determined by how big/wide the brim is. If too few rods are used, the very edge of the brim may not be smooth and flat, and the brim may sag.

Without the ribs or rods 8, the size of the brim 6 will be limited to about 4 inches. Anything larger than 4 inches will allow the brim to flop or collapse due to the weight of the material it is made from. Once the brim collapses, it will not provide as effective a sun shield, and it will also be a nuisance and block the user's field of vision.

Figure 5:
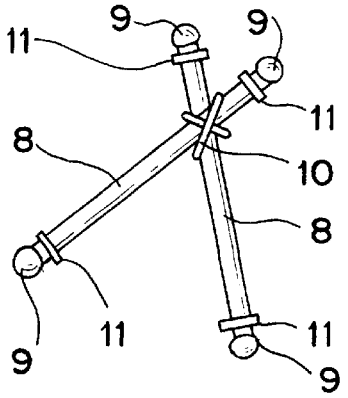
FIG. 5 is a view of the stiffening ribs used with the hat of the present invention.

The ribs or rods 8 are attached in pairs as shown in FIGS. 4 and 5. The ribs can be made from any relatively rigid material such as, but not limited to bone, wood or plastic. As shown in FIG. 5, the ribs or rods 8 are attached in an offset X-shape. That is the ribs or rods 8 are attached to each other at a position closer to one end of the ribs or rods 8 than to the other end, which will allow the ribs to "fan out" as they extend away from the point of attachment. As shown in FIG. 4, the ribs or rods 8 are positioned on the underside of the brim 6 so that the widest distance between adjacent ribs is adjacent the edge of the brim and the narrowest distance between adjacent ribs is adjacent the crown 5. This will provide greater support for the brim as it progresses away from the crown.

Before attaching the ribs or rods 8 to the underside of the brim 6, each end of the ribs or rods 8 is provided with an enlargement 9, such as, but not limited to, a blob of hot glue. The enlargements on each end of the ribs or rods 8 will prevent them from slipping off the securing means 10, 11 which will secure them to the brim 6.

Once the enlargements 9 are attached to each end of the ribs or rods 8, a pair of ribs will be placed in position on the underside of the brim 6, and then they can be attached by sewing an X-shape as shown at 10 in FIG. 5 where the ribs or rods 8 cross each other, and by sewing across the other ends of the ribs or rods 8 as shown at 11. It should be noted that sewing is merely one of the means that can be used to secure the ribs or rods 8 to the underside of the brim 6. Any conventional attachment means can be used without departing from the scope of the invention. In addition, once all the ribs or rods 8 are attached, a piece of material (not shown) can be used to cover the underside of the brim 6 to hide the ribs or rods 8.

In addition, spaces of about ¼ to ½ of an inch should be positioned between adjacent pairs of ribs or rods 8 in order to allow the hat to be folded to a compact size for storage or transportation. Also, ribbons 7 or an elastic cord, etc. can be attached to the hat, as shown in FIG. 3, to allow the hat to be secured to a wearer's head by tying the ribbons under the wearer's chin.

Although the Non-Floppy Sun Hat and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A hat comprising:

a crown having a length and a width, and a brim having a length and a width, said brim having a top side facing said crown, and an underside facing away from said crown, the width of the brim being larger than the width of the crown, stiffening means positioned on the underside of said brim, and wherein said stiffening means comprises at least a plurality of ribs, with pairs of said plurality of ribs attached together in an X-shape, one end of each of said plurality of ribs being attached adjacent an edge of said brim, another end of said plurality of ribs being attached adjacent said crown but spaced from said crown, whereby an empty spaced is formed between said crown and another end of each of said plurality of ribs, and wherein each of said pairs of said plurality of ribs are not attached directly to adjacent pairs of said plurality of ribs.

2. The hat as claimed in claim 1, wherein said ribs are attached in an offset X-shape.

3. The hat as claimed in claim 1, wherein said ribs are attached to each other in a crossing manner, and wherein a distance between said first end of said ribs is larger than a distance between a second end of said ribs.

4. The hat as claimed in claim 3, wherein the ends of said ribs which have the smallest distance between them is positioned closer to said crown.

5. The hat as claimed in claim 1, wherein each of said ribs having an enlargement on each end.

* * * * *